US007780166B1

(12) United States Patent
Paxton et al.

(10) Patent No.: US 7,780,166 B1
(45) Date of Patent: Aug. 24, 2010

(54) GAME HAVING AN ELECTRONIC INSTRUCTION UNIT WITH A MECHANICAL DIE AGITATOR

(75) Inventors: William B. Paxton, Elmhurst, IL (US); Samuel C. Unsicker, Woodridge, IL (US)

(73) Assignee: Big Monster Toys, LLC, Chicago, IL (US)

( * ) Notice: Subject to any disclaimer, the term of this patent is extended or adjusted under 35 U.S.C. 154(b) by 775 days.

(21) Appl. No.: 11/421,647

(22) Filed: Jun. 1, 2006

(51) Int. Cl.
*A63F 9/04* (2006.01)

(52) U.S. Cl. ..... 273/145 C

(58) Field of Classification Search ..... None
See application file for complete search history.

(56) References Cited

U.S. PATENT DOCUMENTS

| | | | | | |
|---|---|---|---|---|---|
| 1,766,134 | A | * | 6/1930 | Lauterbach | 273/145 D |
| 3,111,321 | A | | 11/1963 | Hormann | 273/136 |
| 3,164,918 | A | * | 1/1965 | Brown | 40/547 |
| 3,356,369 | A | * | 12/1967 | Stubbmann | 273/145 CA |
| 3,450,408 | A | | 6/1969 | Hagerman | 273/146 |
| 3,843,131 | A | | 10/1974 | Stubbmann | 273/134 G |
| 4,114,290 | A | * | 9/1978 | Cooper | 434/200 |
| 4,171,813 | A | | 10/1979 | Kuna et al. | 273/237 |
| 4,240,638 | A | | 12/1980 | Morrison et al. | 273/237 |
| 4,323,248 | A | | 4/1982 | Zingale | 273/236 |
| 4,363,482 | A | | 12/1982 | Goldfarb | 463/9 |
| 4,572,513 | A | | 2/1986 | Evans | 273/242 |
| 4,632,397 | A | * | 12/1986 | Rivkin | 273/145 CA |
| 4,669,728 | A | | 6/1987 | Carden | 273/138 A |
| 4,770,416 | A | | 9/1988 | Shimizu et al. | 273/1 GC |
| D304,351 | S | * | 10/1989 | Restaino | D21/492 |
| 4,957,291 | A | | 9/1990 | Miffitt et al. | 273/153 R |
| 4,969,647 | A | | 11/1990 | Mical et al. | 273/85 G |
| 5,009,419 | A | | 4/1991 | Streeter | 273/454 |
| 5,011,156 | A | | 4/1991 | LaChance, Jr. et al. | 273/237 |
| 5,031,913 | A | * | 7/1991 | Hirosumi et al. | 273/145 C |
| D320,624 | S | | 10/1991 | Taylor | D21/13 |

(Continued)

OTHER PUBLICATIONS

U.S. Appl. No. 10/941,590, entitled "Electronic Sequence Matching Game and Method of Game Play Using Same," filed Sep. 15, 2004 (47 pages).

(Continued)

*Primary Examiner*—Gene Kim
*Assistant Examiner*—Dolores Collins
(74) *Attorney, Agent, or Firm*—Miller, Matthias & Hull

(57) ABSTRACT

A game for multiple players having an instruction unit and a plurality of game cards each having gameplay indicia disposed thereon. The instruction unit includes a mechanical number selection device, such as a Pop-O-Matic type die agitator, configured to randomly select one of a plurality of available numbers for the game, a first input device operatively connected to the mechanical number selection device and responsive to actuation of the mechanical number selection device, and a first output device, such as single or multicolored LEDs and/or a speaker. The instruction unit is actuated by a player actuating the mechanical number selection device and the detection of the actuation of the mechanical number selection device by the first input device. The instruction unit selects one of a plurality of colors associated with the game in response to the actuation of the mechanical number selection device, and causes the first output device to provide a sensory perceptible output corresponding to the color selected by the instruction unit.

16 Claims, 7 Drawing Sheets

U.S. PATENT DOCUMENTS

| | | | | |
|---|---|---|---|---|
| 5,120,065 | A | 6/1992 | Driscoll et al. | 273/237 |
| 5,277,429 | A | 1/1994 | Smith, III | 273/237 |
| 5,411,271 | A | 5/1995 | Mirando | 273/434 |
| D363,320 | S | 10/1995 | Barthelemy et al. | D21/48 |
| 5,478,240 | A | 12/1995 | Cogliano | 434/327 |
| 5,507,492 | A * | 4/1996 | Adell | 273/144 B |
| 5,685,776 | A | 11/1997 | Stambolic et al. | 463/46 |
| 5,743,526 | A * | 4/1998 | Inoue | 273/144 R |
| 5,816,580 | A | 10/1998 | Osborne et al. | 273/454 |
| 5,839,976 | A | 11/1998 | Darr | 473/414 |
| 5,844,377 | A | 12/1998 | Anderson et al. | 315/251 |
| 5,855,513 | A | 1/1999 | Lam | 463/9 |
| 5,885,157 | A * | 3/1999 | Harada et al. | 463/22 |
| 5,893,798 | A | 4/1999 | Stambolic et al. | 463/46 |
| 5,906,369 | A | 5/1999 | Brennan et al. | 273/238 |
| 6,086,478 | A | 7/2000 | Klitsner et al. | 463/35 |
| 6,150,774 | A | 11/2000 | Mueller et al. | 315/291 |
| 6,210,278 | B1 | 4/2001 | Klitsner | 463/35 |
| 6,375,186 | B1 * | 4/2002 | Joo | 273/144 B |
| 6,540,615 | B2 | 4/2003 | Tanaka et al. | 463/44 |
| 6,755,416 | B2 * | 6/2004 | Nakamoto et al. | 273/145 C |
| 6,848,992 | B2 | 2/2005 | Adams | 463/9 |
| 7,185,889 | B2 * | 3/2007 | VanZanten | 273/274 |
| D556,837 | S * | 12/2007 | Webber | D21/372 |
| 2001/0009866 | A1 | 7/2001 | Klitsner et al. | 463/35 |
| 2002/0111202 | A1 | 8/2002 | Annis et al. | 463/7 |
| 2003/0032468 | A1 | 2/2003 | Adams, Jr. | 463/9 |

OTHER PUBLICATIONS

U.S. Appl. No. 10/947,736, entitled "Game Having an Electronic Instruction Unit," filed Sep. 23, 2004 (42 pages).

U.S. Appl. No. 11/181,092, entitled "Hand-Held Electronic Game Device," filed Jul. 13, 2005 (29 pages).

U.S. Appl. No. 11/194,508, entitled "Electronic Tag Game and Instruction Unit," filed Aug. 1, 2005 (35 pages).

U.S. Appl. No. 11/426,420, entitled "Game Having an Electronic Instruction Unit," filed Jun. 26, 2006 (39 pages).

* cited by examiner

120

124 122

| Phrase No. | Phrase |
|---|---|
| 1. | Ready to get somebody in big trouble? |
| 2. | Deal out the cards then the first player should just pop the bubble |
| 3. | OK let's get going |
| 4. | Get rid of this many |
| 5. | Yellow cards |
| 6. | Blue cards |
| 7. | Green cards |
| 8. | Red cards |
| 9. | Throw away that many |
| 10. | Throw away that many <color phrase>or <color phrase> |
| 11. | Oh yeah |
| 12. | Somebody's in big trouble |
| 13. | Choose a player and have them pop the bubble for some mighty big trouble |
| 14. | You have to take this many cards |
| 15. | Slow down here |
| 16. | Take that card out |
| 17. | Alright |
| 18. | Yeah! We have a winner |
| 19. | Pop the bubble to play again |
| 20. | Hold up! |
| 21. | But wait! |
| 22. | Wait up! |
| 23. | Time for some double trouble |
| 24. | Pop the bubble again |
| 25. | And take those cards too! |
| 26. | And give those cards to another player |
| 27. | How do you like me now? |
| 28. | That's what I'm talking about |

*FIG. 7*

GAME HAVING AN ELECTRONIC INSTRUCTION UNIT WITH A MECHANICAL DIE AGITATOR

BACKGROUND

The patent is directed to a multi-player game, and more particularly to a multi-player game having an electronic instruction unit providing game instructions to the players during the course of gameplay, and including a mechanical die agitator and an electronic randomizer with colored LEDs for controlling gameplay.

Various games having mechanical die agitators for randomly designating numbers and colors have been previously described. For example, U.S. Pat. No. 4,323,248 to Zingale discloses a board game including a board and a chance-taking means for determining and random manner the play of game cards. Four separate chance-taking means are included as part of the game apparatus, each chance-taking means dealing with a separate category such as shape, color, number or letter. A plurality of directional cards are placed at the center of the game board and, when drawn, control the direction of player movements about the board. The board includes indicia indicative of various directions in which player movements can be made. Each player is dealt a plurality of play cards having indicia on their faces representative of different shapes, colors, numbers and letters. The basic objective of the game is to rid oneself of all play cards. By sequential activation of the separate chance-taking means, each player moves to different positions on the board where the taking or discarding of additional cards is required. Inactive players may gamble on whether an active player will succeed in discarding a particular card. If the gamble is successful, the gambling players are permitted to discard gambled cards.

U.S. Pat. No. 3,450,408 to Hagerman discloses a randomizer die assembly which is operative for randomly designating a color. An electrically illuminated educational toy takes the form of a hollow die. A light bulb is provided in a discrete compartment behind each face, and the die encloses a battery and conductive means for causing only the die face which is on top to be illuminated in any at rest position of the die. The bulbs may be distinctively colored and each die face desirably has printed on it the name of the color which it displays. A composite mercury switch located within the die includes a hollow sphere of non-conductive plastic material having six protruding mercury switch wells corresponding to each of the faces of the die. The light for the corresponding face is illuminated when a small body of mercury within the composite switch is disposed within one of the wells.

Various games having electronic randomizers have also been previously described. For example, U.S. Pat. No. 4,669,728 to Carden discloses an electronic base game apparatus including an internally powered electronic playing piece containing a random number generator that drives a visual display within the playing piece for displaying one or more numbers or dot patterns corresponding to the dots displayed by one or two dice which have been rolled. A magnetic field sensor within the playing pieces responsive to a magnetic field-producing element within a base forming part of the apparatus in causing a high-frequency oscillator within the playing piece to stop, causing a counter connected to the output of the oscillator to transfer random numbers based upon the accumulated count to the display input drive lines, and causing the display, which is dark in the absence of a magnetic field energizing the playing a piece of sensor, to display the numbers.

SUMMARY OF THE INVENTION

In one aspect, the present invention is directed to a game for multiple players having an instruction unit and a plurality of game cards each having gameplay indicia disposed thereon. The instruction unit includes a mechanical number selection device configured to randomly select one of a plurality of available numbers for the game, a first input device operatively connected to the mechanical number selection device and responsive to actuation of the mechanical number selection device, and a first output device. The instruction unit is actuated by a player actuating the mechanical number selection device and the detection of the actuation of the mechanical number selection device by the first input device. The instruction unit selects one of a plurality of colors associated with the game in response to the actuation of the mechanical number selection device, and causes the first output device to provide a sensory perceptible output corresponding to the color selected by the instruction unit.

In another aspect, the present invention is directed to an instruction unit for a game having a mechanical number selection device configured to randomly select one of a plurality of available numbers for the game, a first input device operatively coupled to the mechanical number selection device such that actuation of the mechanical number selection device actuates the first input device, a first output device, and a controller operatively coupled to the first input device and the first output device. The controller is programmed to select one of a plurality of colors associated with the game in response to detecting the actuation of the first input device, and to cause the first output device to provide a sensory perceptible output corresponding to the color selected by the controller.

In a further aspect, the present invention is directed to a method of gameplay for a game for a plurality of players. The method includes providing an instruction unit and a deck of game cards, wherein each game card has game indicia disposed thereon, and wherein the instruction unit has a mechanical number selection mechanism and is configured to select one of a plurality of available colors in response to actuation of the mechanical number selection mechanism. The method further includes distributing a plurality of the game cards to each participant of the game, and each player in turn actuating the mechanical number selection mechanism to randomly select one of the available numbers and to cause the instruction unit to select one of the available colors. Additionally, the method includes providing at the instruction unit a sensory perceptible indication of the color selected by the instruction unit; and discarding game cards distributed to the player and having colored indicia disposed thereon matching the color selected and indicated by the instruction unit onto a discard pile up to the number indicated by the mechanical number selection mechanism.

In yet another aspect, the present invention is directed to an instruction unit for a game including a mechanical selection device configured to randomly select one item from a first group of items that are relevant to the gameplay of the game, a first input device operatively coupled to the mechanical selection device such that actuation of the mechanical selection device actuates the first input device, a first output device, and a controller operatively coupled to the first input device and the first output device. The controller is programmed to select one item from a second group of items that are relevant to the gameplay of the game in response to detecting the actuation of the first input device, and to cause the first output device to provide a sensory perceptible output corresponding to the item selected from the second group of items by the controller.

Additional aspects of the invention are defined by the claims of this patent.

BRIEF DESCRIPTION OF THE DRAWINGS

FIG. 7 is a chart of phrase numbers and corresponding phrases that may be used by the electronic instruction unit during the routines of FIGS. 8 and 9;

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
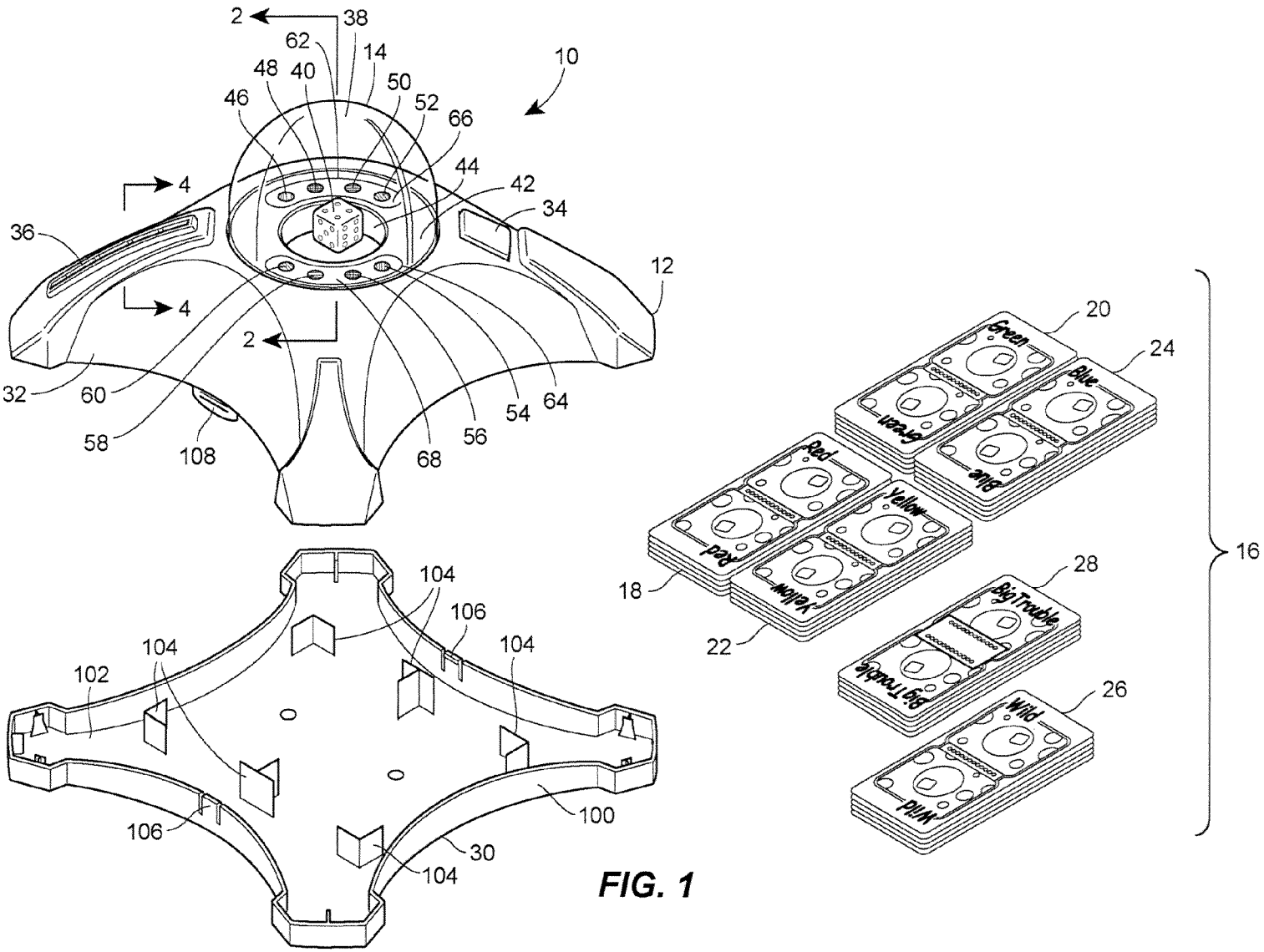
FIG. 1 is a perspective view of an embodiment of game having an electronic instruction unit in accordance with the invention.

FIG. 1 illustrates one possible embodiment of a game 10 for a plurality of players having an electronic instruction unit 12 with a die agitator 14 in accordance with the invention. The embodiment of the game 10 illustrated in FIG. 1 is based on the Trouble family of games, with each player being dealt a plurality of game cards to start, and with the players in turn discarding cards from their hand and selecting additional cards from the deck based on instructions from the instruction unit 12 and the number on the top face of the die when the agitator 14 is "popped" until one of the players has discarded all of their cards. In one embodiment, the players are dealt seven cards from the deck at the beginning of the game. In turn, a player presses the agitator 14 to randomly reorient the die and to activate the electronic instruction unit 12. The instruction unit 12 will direct the player to pick up or discard the number of cards appearing on the top face of the die, with the color of the cards being determined by random selection by the electronic instruction unit 12 and displayed via the colored LEDs. At times, the electronic instruction unit 12 may provide the player with an option of two colors of cards, with the LEDs displaying both colors. A player may also use a "Big Trouble" card at the end of their turn in order to make another player draw cards from the deck. The "Big Trouble" card is inserted by the player into a designated slot of the electronic instruction unit 12 to cause the instruction unit 12 to select and broadcast instructions for the player or players to select cards. The player using the "Big Trouble" card selects another player to press the die agitator 14 and to act on the instructions broadcast by the electronic instruction unit 12.

This embodiment and the drawing figures herein are exemplary only, and are not intended to limit the scope of the claims to this particular embodiment. Other configurations of the game 10 are contemplated having, for example, different configurations of the game cards, different electronic instruction units, different agitator devices, and other variations that are within the scope of the claims defining the invention. Furthermore, it is contemplated that the game 10, in addition to the electronic instruction unit 12, may be implemented partially or entirely through electronic and/or graphic means such that the game layout, game pieces, game cards and audio portions of the game are presented via video or audio technology.

Referring now to FIG. 1, the game 10 may include the electronic instruction unit 12 having the die agitator 14, a deck of game cards 16 including game cards 18, 20, 22, 24, 26, 28 having varying colors and indicia thereon, and a storage base 30. The electronic instruction unit 12 may be any electrical unit capable of receiving an input from a player, and of broadcasting or displaying an instruction to the players in response to receiving the input from the player. In the illustrated embodiment, the electronic instruction unit 12 has a housing 32 enclosing the internal components of the instruction unit 12, and supporting the die agitator 14 as well as a win button 34 and a card a slot 36. The components and operation of the instruction unit 12, and its use during the game 10, will be discussed more fully hereinafter.

The die agitator 14 may be a standard Pop-O-Matic type die agitator having a translucent dome 38 that is pressed downwardly and released to randomly reorient a die 40 disposed therein. The die agitator 14 may further include a support structure 42 disposed within the dome 40 and defining a recess or well 44 in which the die 40 rests after reorientation. The support structure 42 also supports a plurality of colored LEDs 46-60 that are operatively connected to the internal components of the electronic instruction unit 12. In the illustrated embodiment, LEDs 46-52 and LEDs 54-60 may be disposed within opposite recesses 62, 64, respectively, of the support structure 42 and covered by wholly or partially translucent LED covers 66, 68 such that the light from the LEDs 46-60 is visible through the dome 38 when they are illuminated.

Figure 3:
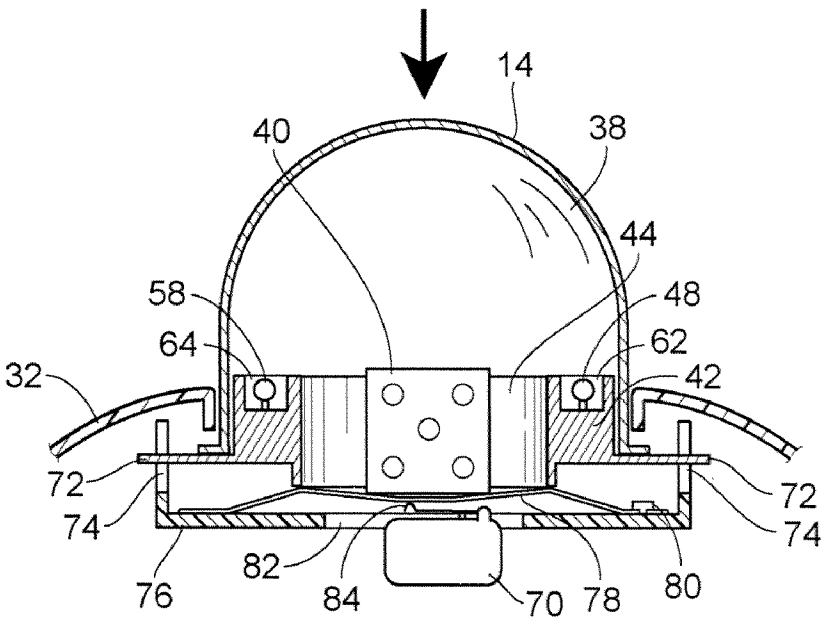
FIG. 3 is a schematic cross-sectional view of the die agitator and corresponding switch in a depressed position.
Figure 2:
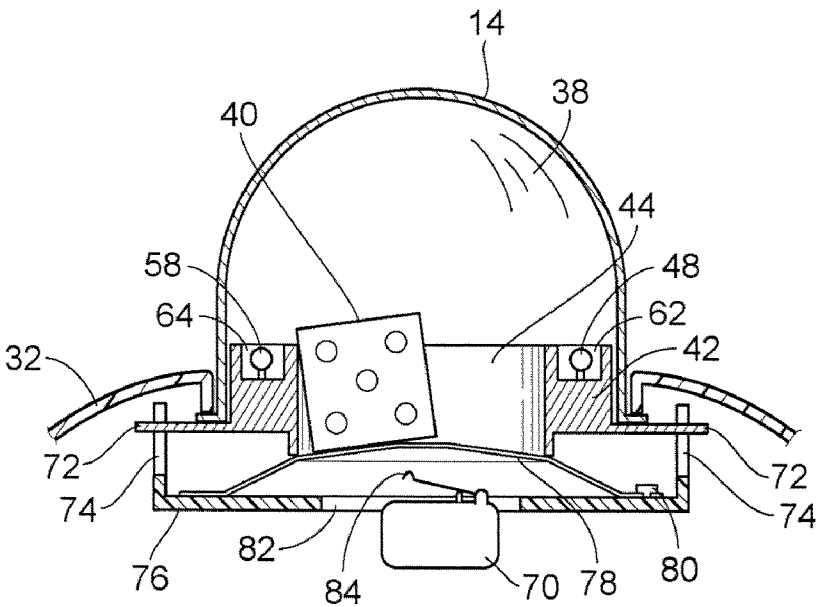
FIG. 2 is a schematic cross-sectional view taken through line 2-2 of FIG. 1 of the die agitator and corresponding switch in a normal position.

FIGS. 2 and 3 illustrate a schematic partial cross-sectional view of the die agitator 14 and an agitator switch 70 within the electronic instruction unit 12 that may be actuated when the die agitator 14 is pressed. The support structure 42 may include outwardly extending flanges or arms 72 that are received and aligned by support post 74 of a base 76 within the housing 32. The dome 38, die 40 and support structure 42 are supported in the upward position shown in FIG. 2 within the housing 32 by a spring 78 disposed on the base 76 and partially held in place by a screw 80. In the illustrated embodiment, the spring 78 is a resiliently bendable leaf spring having a snap acting portion, and is disposed directly under the dome 38 and support structure 42 such that the spring 78 forms the bottom wall of the well 44. Further, the agitator switch 70 is disposed within an opening 82 in the base 76 below the spring 78 with a switch arm 84 of the agitator switch 70 extending upwardly towards the spring 78 when the agitator switch 70 is open.

When a force is applied to the dome 38 as shown in FIG. 3, such as by the hand of a player, the spring 78 is depressed. As the spring 78 moves downwardly, the spring 78 engages the switch arm 84 of the agitator switch 70 to close the agitator switch 70. As will be discussed more fully below, the closing of the agitator switch 70 in response to the pressing of the die agitator 14 causes the electronic instruction unit 12 to perform processing to control the gameplay of the game 10. When the dome 38 is released and the spring 78 returns to the normal position of FIG. 2, the return snap of the spring 78 forcefully throws the die 40 upwardly clear of the spring whereby the die 40 is shaken and tumbled to randomly reorient the die. At the same time, the switch arm 84 is disengaged by the spring 78 to open the agitator switch 70. When the die 40 again lands on the spring 78, the upwardly turned face of the die 40 displays a value indicating a number of cards 16 to be discarded, drawn or passed by a player as instructed by the electronic instruction unit 12.

Those skilled in the art will understand that the illustrated embodiment is but one example of a combination of a die agitator and a switch that may randomly reorient a die and detect the operation of the die agitator to cause a response by the electronic instruction unit 12. Moreover, other mechanical random number selection devices may be implemented in the instruction unit 12 that may make a random selection from a plurality of available numbers that are relevant to the gameplay of the game 10, and the actuation of which may be detected by an input device of the instruction unit 12 such as the switch 70. For example, selection devices implementing wheels, dials and other rotatable elements may be implemented in the instruction unit 12. Other configurations of randomizing devices and corresponding switches or other input devices are contemplated by the inventors is having used in a game 10 in accordance with the invention.

Figure 5:
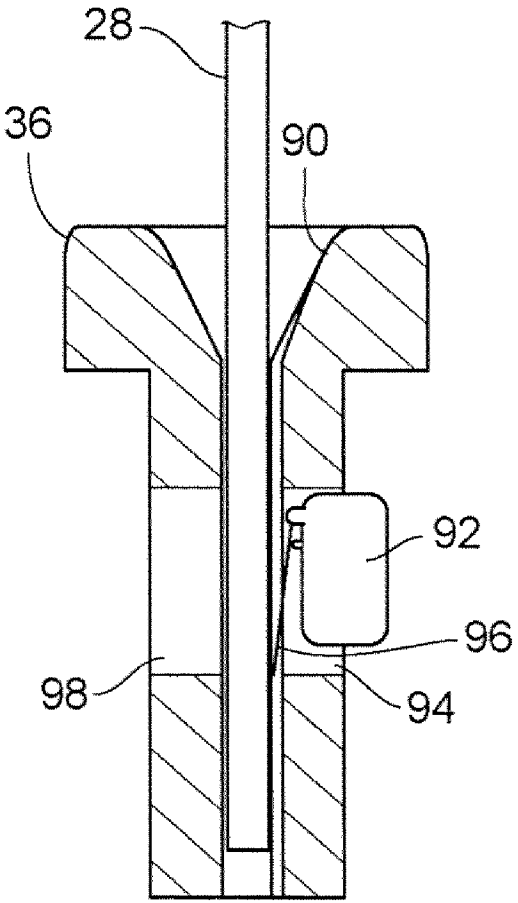
FIG. 5 is a schematic cross-sectional view of the card slot and corresponding switch with a game card inserted therein.
Figure 4:
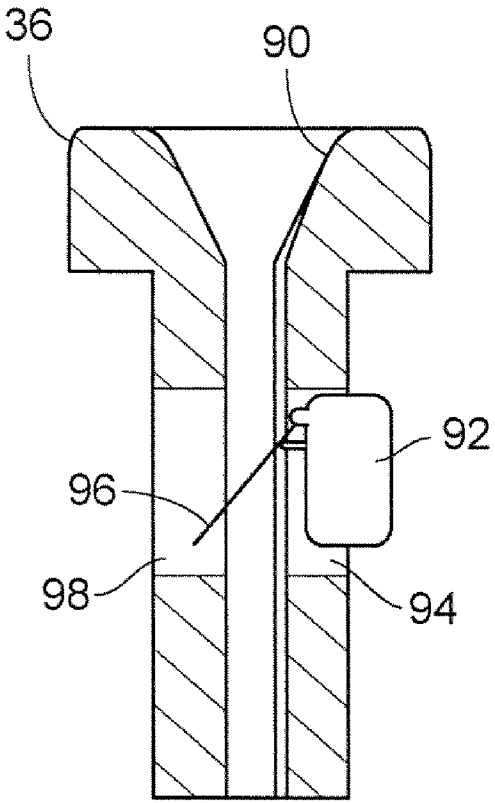
FIG. 4 is a schematic cross-sectional view taken through line 4-4 of FIG. 1 of the card slot and corresponding switch.

Returning to FIG. 1, the electronic instruction unit 12 includes other mechanisms for receiving input from the players during the course of gameplay. The win button 34 is operatively connected to a switch within the electronic instruction unit 12 that is configured to detect when the win button 34 is pressed by one of the players during a game. Actuation of the switch in response to the pressing of the win button 34 will cause the electronic instruction unit 12 to perform end of game processing in a mariner described more fully below. The electronic instruction unit 12 also receives input from the players via the card slot 36 through the housing 32. Referring to FIGS. 4 and 5, the card slot 36 is configured to receive and retain one of the cards 16 from the deck, and in particular one of the Big Trouble cards 28, when the card 16 is inserted through an opening 90 of the card slot 36. The card slot 36 narrows to engage the surfaces of the card 28 inserted therein to hold the card 28 in position. A card switch 92 is disposed proximate an opening 94 through a side of the card slot 36, and includes a switch arm 96 extending through the opening 94 and across the card slot 36 when a card 16 is not disposed within the card slot 36. The card slot 36 may include an additional opening 98 through the opposite side of the card slot 36 and into which the switch arm 96 may extend.

As the card 28 is inserted through the opening 86 of the card slot 36, the leading edge of the card 28 engages the switch arm 96 of the card switch 92 to close the card switch 92. As will be discussed more fully below, the closing of the card switch 92 in response to the insertion of the card 28 causes the electronic instruction unit 12 to perform processing to control the gameplay of the game 10. When the card 28 is removed from the card slot 36, the switch arm 96 is disengaged by the card 28 to open the card switch 92, thereby indicating to the electronic instruction unit 12 that the card 28 has been removed. Those skilled in the art will understand that the illustrated embodiment is but one example of a card slot and switch arrangement that may detect the placement and removal of a card in a particular location with respect to the electronic instruction unit 12 to cause a response by the electronic instruction unit 12, and such arrangements are contemplated by the inventors as having used in a game 10 in accordance with the invention.

Referring back to FIG. 1, the deck of cards 16 may include a plurality of cards 18-28 having indicia disposed thereon that, along with the rules for the game 10, dictate the way in which the cards 16 may be played by the players during the course of the game 10. As previously discussed, each player may be dealt a plurality of cards 16 from the deck at the start of the game 10. During a player's turn, the player may be able to lay down one or more of the cards 16 in the player's hand on a discard pile depending on the number on the die 40, the color(s) of the LEDs illuminated by the electronic instruction unit 12, and the indicia on the cards 16 in the player's hand. The game 10 may include a plurality of different types of cards 18-28, each having unique gameplay characteristics when played alone or in combination with other types of cards 18-28.

The cards 18-24 are colored red, green, yellow and blue, respectively, to correspond to the colors of the LEDs 46-60. The players will pick up or discard the number of cards 18-24 appearing on the die and matching the color of the illuminated LEDs 46-60 according to the rules described more fully below. It should be noted that the particular colors, the number of colors, and the display devices for the colors (LEDs 46-60) are exemplary only, and may be varied based on the needs of a particular implementation of an instruction unit 12 and gameplay of game 10. For example, more or fewer differing colors may be implemented. Further, other electrical or electro-mechanical output devices capable of providing a visually perceptible output corresponding to a color selected by instruction unit 12 from a plurality of available color selections for the game 10 may be substituted for the LEDs 46-60. Consequently, the instruction unit 12 could include multicolor LEDs, colored incandescent lights, LCD displays, motor-driven wheels or dials or other output devices that may be operated to display a selected one of a plurality of colors or other items available for selection by the instruction unit 12.

The wild cards 26 are also dealt to the players from the deck of cards 16, and may be discarded at the player's discretion in lieu of a colored card 18-24 matching the illuminated LEDs 46-60. Finally, the Big Trouble cards 28 include distinct identifying indicia distinguishing the cards 28 from the other cards 18-26. A Big Trouble card 28 in a player's hand may be played at an appropriate time by inserting the card 28 into the card slot 36 to actuate the card switch 92 as described above. In response to the actuation of the card switch 92, the electronic instruction unit 12 will select and play an instruction to select another player to press the die agitator 14 and to follow a subsequent instruction played by the electronic instruction unit 12.

The base 30 of the game 10 may be configured as an open-ended hollow tray having an outer wall 100 and a bottom wall 102. The outer wall 100 may be dimensioned to correspond to the outer circumference of the instruction unit 12, and to provide sufficient space to receive the deck of cards 16 therein. The base 30 may further include inner walls 104 defining card storage areas adapted to receive all or a portion of the stacked deck of cards 16 and to maintain the deck of cards 16 in substantial vertical alignment. To facilitate removal of the deck of cards 16, the inner walls 104 may include cutout portions or gaps therebetween allowing a player to reach into the base 30, grasp the deck of cards 16 from the sides, and lift the deck of cards 16 out of the base 30. In order to secure the electronic instruction unit 12 to the base 30, the base 30 may further include oppositely disposed tabs 106 adapted to receive corresponding fingers 108 on the bottom of the electronic instruction unit 12 and to retentively engage the fingers 108 to demountably attach the electronic instruction unit 12 to the base 30 and enclose the deck of cards 16 therein.

At the start of the game 10, the instruction unit 12 may be placed in the center of the playing area, the deck of cards 16 may be shuffled, and an equal number of the cards 16 may be dealt out to each player. The remaining cards 16 in the deck may be placed face down in the middle of the playing area. The game may begin by turning on the instruction unit 12 and actuating the unit 12 in a manner described more fully below to start the game. On each player's turn, the player may either press the dome 38 of the die agitator 14 and attempt to discard the cards 16 in the player's hand according to the roll of the die 40 and the color(s) down 10 lines of the illuminated LEDs 46-60, or the player can insert a Big Trouble card 28 into the card slot 36 and select another player to draw cards 16 from the deck according to the instructions from the electronic instruction unit 12. Play may proceed with each player in turn either actuating the die agitator 14 or inserting a Big Trouble card 28 into the card slot 36 until one of the players discards all of cards 16 in their hand and presses the win button 34.

Figure 6:
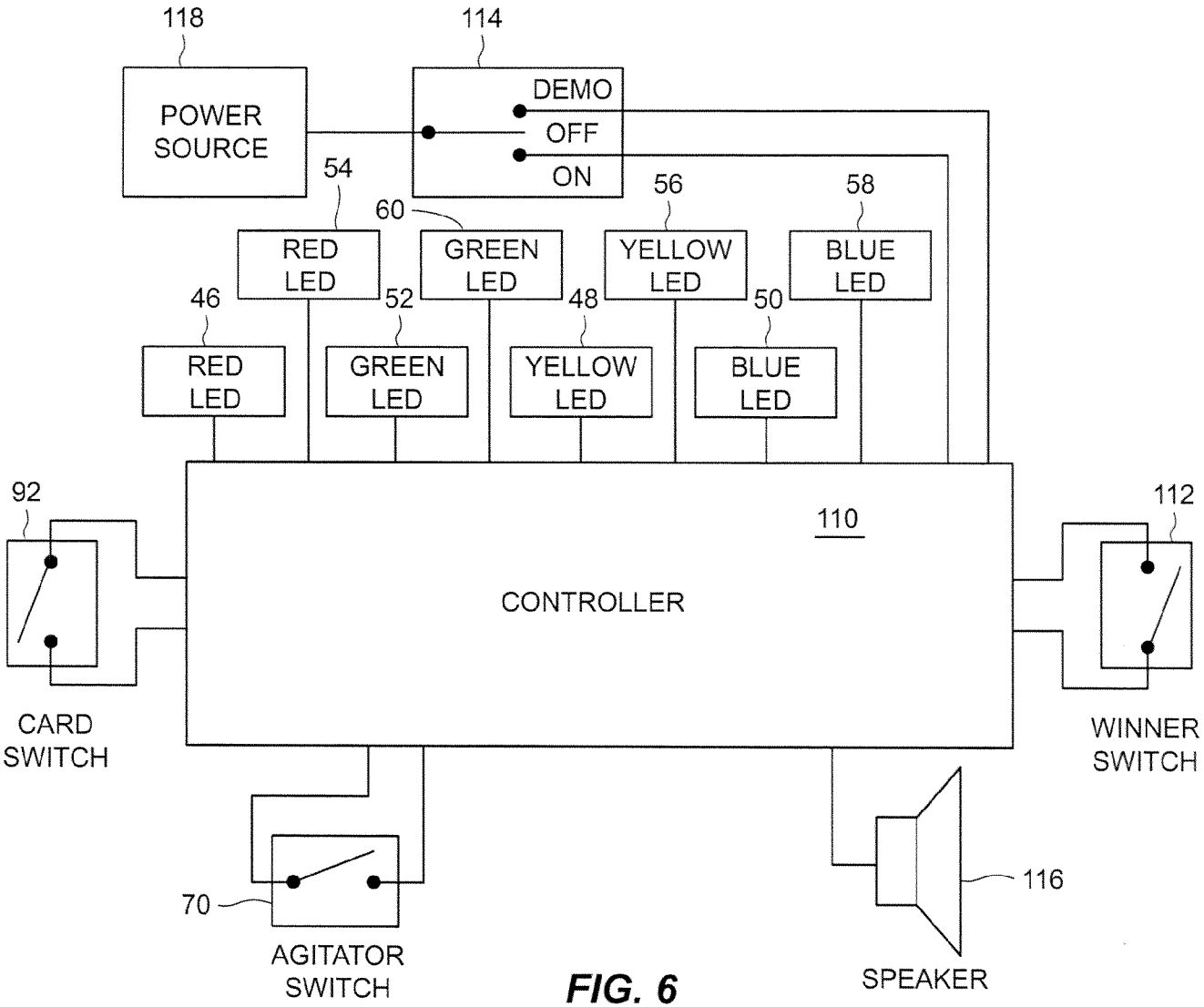
FIG. 6 is a block diagram of the electronic components of the electronic instruction unit for the game of FIG. 1.

The structure of the instruction unit 12 will now be discussed with reference to FIG. 6. FIG. 6 is a block diagram of a number of components that may be incorporated in the instruction unit 12. The instruction unit 12 may include a controller 110 containing the game logic and sound generation data implemented via circuitry contained on a conventional printed circuit board, with the game execution logic and sound generation data being stored directly on the printed circuit board. It should be appreciated that although the controller 110 may be implemented on a printed circuit board, more complex implementations of the game 10 may be implemented wherein the controller 110 may comprise, among other components, a program memory, a microcontroller or microprocessor (MP), a random-access memory (RAM), read-only memory (ROM) and an input/output (I/O) circuit, all of which may be interconnected. It should be appreciated that the controller 110 may include multiple microprocessors. Similarly, the memory of the controller 110 may include multiple RAMs and multiple program memories, depending on the complexity and requirements of a specific implementation. It should also be appreciated that the I/O circuit may include a number of different types of I/O circuits, such as sound generation circuits, video generation circuits, odor generation circuitry, and the like. The RAM(s), ROM(s) and program memories may be implemented as semiconductor memories, magnetically readable memories, and/or optically readable memories, for example.

FIG. 6 illustrates that the controller 110 may be operatively coupled to the agitator switch 70, the card switch 92, a win switch 112, LEDs 46-60, a three-way mode switch 114 and a speaker 116, each of those components being so coupled via a respective direct line or conductor. In addition, the three-way mode switch 114 may be operatively coupled to a power source 118. Different connection schemes could be used. The three-way mode switch 114 may be coupled to the controller 110 such that the instruction unit 12 may operate in a demonstration mode when the switch 114 is set to the "DEMO" position, may operate in a gameplay mode when the switch 114 is set to the "ON" position, and may be powered off when the switch 114 is set to the "OFF" position. The operation of the instruction unit 12 in the demonstration and gameplay modes is discussed more fully below.

When the three-way mode switch 114 is set to either the "DEMO" position or the "ON" position, the controller 110 may be connected to the power source 118, which may be batteries inserted into a battery compartment of the instruction unit 12, an external battery, a power cord connected to a wall outlet, or any other appropriate source of electrical power, such that the power source 118 may provide power to the controller 110, circuitry and other components 46-60, 70, 92 and 112-116. Input signals produced by the switches 70, 92, 112 are output to the controller 110 for processing by the game execution logic in both the demonstration and the gameplay modes. Depending on the processing performed, the circuitry of the controller 110 generates and outputs sound generation signals to the speaker 116, wherein the speaker 116 translates the output signals into sounds that are broadcast through holes in the housing 32 of the instruction unit 12 such that the sounds may be heard by the participants of the game 10. The general and specific technologies relating to electronic sound generation circuitry, and the software required to run such devices, are well known to those skilled in the electronic and software arts, and therefore the specific details of the digital processing and memory portions of such circuitry, and the specific details of any software required for this specific application will not be described further herein.

While the output device or mechanism for the instruction unit 12 is illustrated herein as the speaker 116 which may broadcast game instructions that may be audibly perceptible to the players, those skilled in the art will understand that the instruction unit 12 may be implemented with an desired output device capable of conveying the game instructions in any manner that may be perceptible to the players. For example, in an alternative embodiment, the output device for the instruction unit 12 may be a visual display for the game instructions that may be viewable by the players to convey the game instructions. As a further alternative, the output device may be a printer to which the controller 110 may output signals causing the printer to print and dispense game instructions when a player actuates one of the switches 70, 92, 112. Other output devices or mechanisms may be implemented in the instruction unit 12 as desired, and are contemplated by the inventors as having use with the game 10 and instruction unit 12 of the present invention.

As previously discussed, the controller 110 receives input signals from the switches 70, 92, 112, and the input signals cause the controller 110 to process the game execution logic in the demonstration and gameplay modes. In one embodiment of the instruction unit 12 wherein the switches 70, 92, 112 may be micro switches disposed within the housing 32 of the instruction unit 12 and configured to be actuated in response to displacement of the die agitator 14, insertion of a card 16 in the card slot 36 and movement of the win button 34, respectively. When the die agitator 14 and win button 34 are in their normal positions, and no card 16 is inserted in the card slot 36, the micro switches 70, 92, 112 are not actuated and do not transmit input signals to the controller 110. During the course of the game 10, the player may actuate the micro switches 70, 92, 112 and, correspondingly, activate the instruction unit 12. With the micro switches 70, 92, 112 actuated, input signals are transmitted to the controller 110 to thereby cause the controller 110 to process the demonstration or game execution logic stored thereon.

While the micro switches 70, 92, 112 are discussed herein as transmitting input signals to the controller 110 indicating the actuation of the micro switches 70, 92, 112, those skilled in the art will understand that the micro switches 70, 92, 112 may be configured to transmit a continuous input signal when the micro switches 70, 92, 112 are in their normal positions, and discontinue the input signals when the micro switches 70, 92, 112 are actuated, thereby informing the controller 110 of the input from the players by the absence of input signals from the micro switches 70, 92, 112. Further, while the switches 70, 92, 112 are described herein as micro switches, the switches 70, 92, may be implemented via any type of switch or other input mechanism that may detect input at the instruction unit 12 by a player. For example, the card switch 92 may be an optical sensor configured to transmit input signals to the controller 110 indicating the proximity of a card 16 to the instruction unit 12 when the card 16 covers the optical sensor. Further, if desired, the sensor and controller 110 may be configured with recognition capabilities and software to ensure that a Big Trouble card 28 has been played by the player and not one of the other types of cards 16. As a further alternative, the win switch 112 may be implemented via a switch that detects the pressure from the player on the win button 34, either directly or via some other mechanism capable of applying pressure to the switch 112 in response to an input by the player. Those skilled in the art will understand that other mechanisms for detecting an input by the player and causing an input signal or otherwise activating the controller 110 to process the game execution logic may be implemented in an instruction unit 100, and are contemplated as having use with the present invention.

As previously discussed, the instruction unit 12 may operate in either a demonstration mode or a gameplay mode. In order to activate the instruction unit in the demonstration mode, the three-way switch 114 may be moved the "DEMO" position, thereby causing the controller 110 to execute the demonstration mode logic programmed therein. While in the demonstration mode, the controller 110 may be programmed to transmit one of a plurality of available sound generation signals to the speaker 116 in response to detecting the activation of the agitator switch 70 or the win switch 112. The controller 110 may store sound generation signals corresponding to a plurality of phrases and other sounds that may be broadcast from the instruction unit 12 in the demonstration and gameplay modes. FIG. 7 is a table 120 containing a plurality of phrases 122 and corresponding phrase identification numbers 124 that may be stored at the controller 110 in the form of sound generation signals for use by the instruction unit 12. The controller 110 may cause the sound generation signals for one or more of the phrases 122 to be output to the speaker 116 in response to instructions within the demonstration mode or gameplay mode logic to output the sound generation signals for the corresponding one or more of the phrase identification numbers 124. For example, during the demonstration mode, the logic programmed into the controller 110 may cause the controller 110 to randomly or sequentially select one of the available phrases 122 of table 120, such as one of phrase numbers 1 ("Ready to get somebody in big trouble?"), 12 ("Somebody's in big trouble") or 28 ("That's what I'm talking about"), in response to the activation of the switches 70 or 112. Once the phrase is selected, the controller 110 may then output the corresponding sound generation signals to the speaker 116 for broadcasting to the person pressing the die agitator 14 or win button 34 to induce the person to purchase the game 10.

Figure 8:
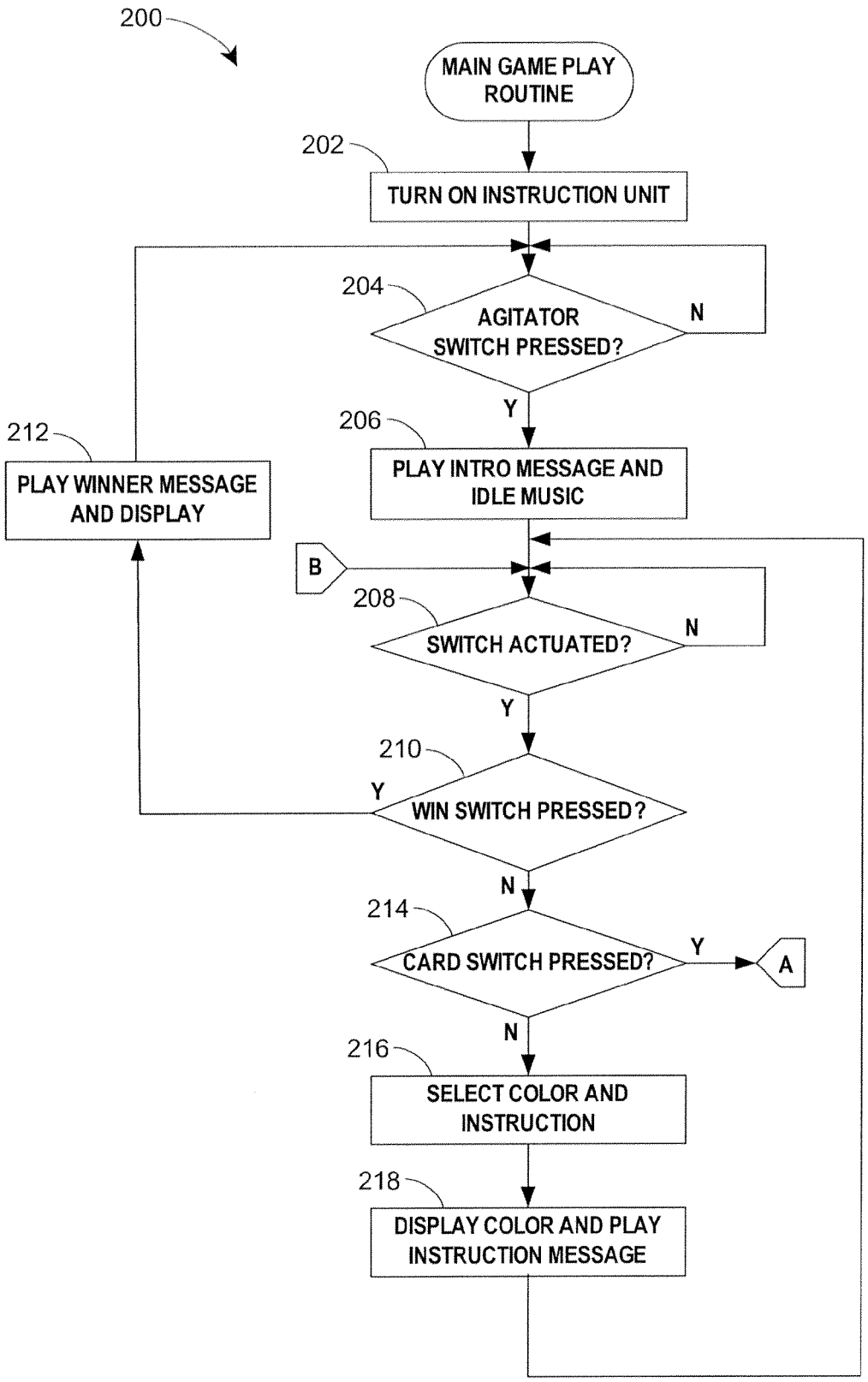
FIG. 8 is a flowchart of an embodiment of a main gameplay routine that may be performed by the electronic instruction unit during the game.

FIG. 8 is a flowchart of a main gameplay routine 200 that may be stored in the memory of the controller 110 and executed when the instruction unit 12 is in the gameplay mode. The main gameplay routine 200 may begin operation at block 202 wherein the three-way switch 114 of the instruction unit 12 may be moved to the "ON" position by a player. After the three-way switch 114 is set to the "ON" position, control may pass to a block 204 wherein the controller 110 evaluates whether the die agitator 14 of the instruction unit 12 has been pressed by a player and, correspondingly, the agitator switch 70 has been actuated. If actuation of the agitator switch 70 is not detected by the controller 110, control loops back to the block 204 until the agitator switch 70 is actuated. The controller 110 may be programmed with time out logic such that the instruction unit 12 may periodically output a reminder prompt while waiting for one of the players to press the die agitator 14. Eventually, after a predetermined period of time, the instruction unit 12 may enter a sleep or power save mode to conserve power, and may return to an active mode once the agitator switch 70 is actuated. Also during this time, the controller 110 may be programmed to ignore actuation of the switches 92, 112 such that the instruction unit 12 does not output a response to the actuation of the switches 92, 112 before the game starts.

Once the actuation of the agitator switch 70 is detected at block 204, control passes to a block 206 wherein the controller 110 outputs sound generation signals for an introductory message, such as a combination of phrase numbers 1 and 2 ("Deal out the cards then the first player should just popped bubble") of table 120, along with introductory music. At the same time, the controller 110 may cause the LEDs 46-60 to be illuminated in a pre-programmed order to produce an introductory light display to accompany the introductory message. After the introduction, the controller 110 may output sound generation signals for idle music to be output from the speaker 116 while the controller 110 waits for the player to actuate one of the switches 70, 92, 112. At the same time, the controller 110 causes the LEDs 46-60 to illuminate in a light display that may be synchronized to the idle music.

While the idle music and accompanying light display are output by the instruction unit 12, control passes to a block 208 to wait for one of the switches 70, 92, 112 to be actuated in response to a player pressing the die agitator 14, inserting a card 16 into the card slot 36 or pressing the win button 34, respectively. If none of the switches 70, 92, 112 are actuated, the controller 110 continues to wait for the players while the idle music and light display are output by the instruction unit 12. As with the block 204, the controller 110 may include time out logic and reminder prompts for the players that are executed by the controller 110 while the controller 110 waits for input from the players. After a predetermined period of time elapses without input from the players and the controller 110 enters the sleep mode, the controller 110 may stop the output of the idle music and LED display at the instruction unit 12, and pass control back to block 204 to wait for the agitator switch 70 to be actuated to start a new game.

Once the controller 110 detects the actuation of any of the switches 70, 92, 112 at block 208, the processing performed by the controller 110 is determined based on the switches 70, 92, 112 that was actuated by the player. If the controller 110 determines that the win switch 112 was actuated at a blocked 210, control passes to a blocked 212 were the controller 110 outputs sound generation signals to the speaker of 116 for a winner message, such as that formed by the combination of phrase numbers 18 ("Yeah! We have a winner") and 19 ("Pop up the bubble to play again") of table 120. At the same time, the controller 110 outputs sound generation signals to the speaker 116 for accompanying win music, and causes the LEDs 46-60 to be illuminated in a predetermined win display. After the win message, music and display are output at the instruction unit 12, the controller 110 may again cause the control unit 12 to output the idle music and LED display, and pass control back to block 204 to wait for a player to actuate the agitator switch 70 and begin the next game.

Figure 9:
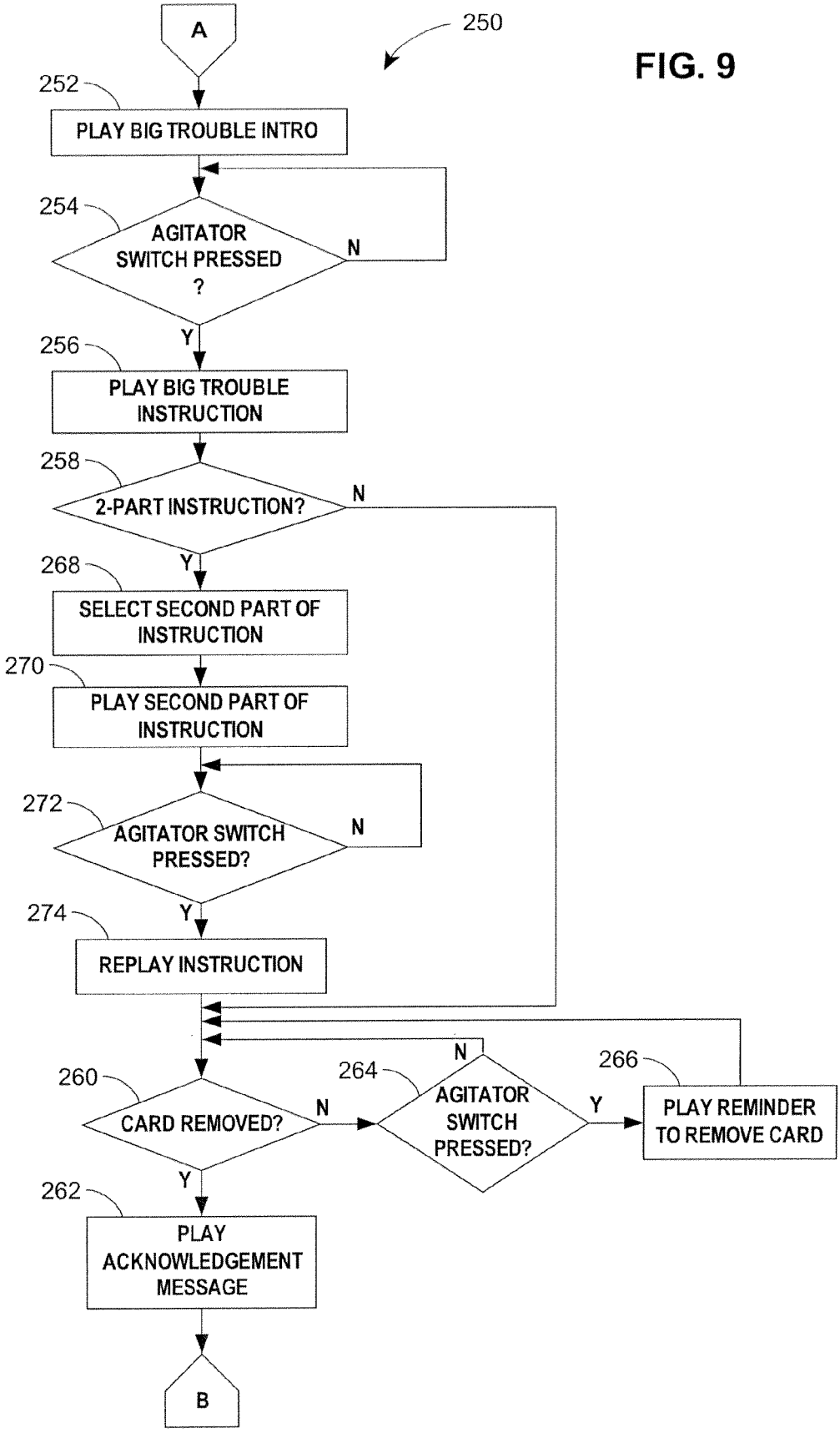
FIG. 9 is a flowchart of an embodiment of a Big Trouble routine that may be performed by the electronic instruction unit during the game.

If the controller 110 determines that the win switch 112 was not actuated at block 210, controlled passes to a blocked 214 to determine if the card switch 92 was actuated in response to a Big Trouble card 28 being inserted into the card slot 36. If the card switch 92 is actuated, control passes to a Big Trouble routine 250 of FIG. 9 that will be discussed more fully below. If neither the card switch 92 nor the win switch 112 is actuated, by default the agitator switch 70 was actuated and control passes to a blocked 216 for selection of a color or colors and an instruction phrase for the player to determine which cards may be discarded by the player during the turn. The controller 110 may be programmed to randomly, sequentially or otherwise select one of the available instruction phrases 124 from the table 120. For example, phrase numbers 4 ("Get rid of this many"), 9 ("Throw a way that many") and 10 ("Throw a way that many <color phrase> or <color phrase>") represent instruction phrases that may be selected by the controller 110 and output by the instruction unit 12. Phrase numbers 4 and 9 are instructions for discarding cards of a single color. When one of these phrases is selected, the controller 110 may then select one of the available colors (yellow, blue, green and red) and the corresponding one of phrase numbers 5-8 (e.g., "yellow cards"), respectively, to be concatenated with the selected instruction and output by the speaker 116. Phrase number 10 is an example of a multicolor discard instruction having to colors associated therewith. When phrase number 10 is selected by the controller 110, the controller 110 also selects two of the available colors and the corresponding phrase numbers 5-8 to be output with phrase number 10 as indicated by the "<color phrase>" notations in phrase number 10. Of course, other instruction phrases and other combinations of colors are contemplated by the inventors and may be implemented in an instruction unit in accordance with the invention.

After the instruction phrase and color(s) are selected by the controller 110, control passes to a blocked 218 wherein the controller 110 outputs sound generation signals for the selected phrases to the speaker 116. At the same time, the controller 110 causes the LEDs 46-60 corresponding to the selected color(s) to be illuminated as the instruction message is broadcast by the speaker 160. After the instruction is output, the controller 110 again causes the speaker 116 to output the idle music while the LEDs 46-60 for the selected color(s) remain illuminated. After the instruction is played, the player discards a combination of cards 16 from the player's hand that match the illuminated color(s), or are wildcards 26, up to the number shown on the top face of the die 40. The instruction unit 12 continues to output the idle music, and control passes back to block 208 to wait for one of the switches 70, 96, 112 to be actuated by one of the players.

If during a players turn the player discards the last card in the player's hand, the player presses the win button 34 to end the game. As discussed above, when the win button 34 is pressed and the win switch 112 is actuated, control passes to block 212 to output the win message, music and display, and then back to block 204 to wait for the die agitator 14 to be pressed to start a new game. If the player has a Big Trouble card 28, the player may insert the card 28 into the card slot 36 to actuate the card switch 92. Depending on the rules of the game, the player may be able to use the card 28 at any time during the player's turn, or may only be allowed to use the card 28 at the end of the player's turn after discarding a number of cards equal to the number on the top face of the die 40. When actuation of one of the switches 70, 92, 112 is detected at block 208 and actuation of the win switch 112 is not detected at block 210, a determination that the card switch 92 is actuated at block 214 causes control to pass to the Big Trouble routine 250 of FIG. 9. The Big Trouble routine 250 begins at a block 252 where the controller 110 outputs sound generation signals to the speaker 116 for a Big Trouble introduction message, such as that provided by phrase numbers 11 ("Oh yeah"), 12 ("Somebody's in big trouble") and 13 ("Choose a player and have them pop the bubble for some mighty big trouble") of table 120. At the same time, the controller 110 causes the LEDs 46-60 to be illuminated in a display corresponding to the Big Trouble introductory message. In response to the introductory message, the player inserting the Big Trouble card 28 into the card slot 36 selects an opponent to press the die agitator 14. In the meantime, control passes to a block 254 wherein the controller 110 waits for actuation of the agitator switch 70.

The opponent selected by the player playing the Big Trouble card 28 presses the die agitator 14 to continue the turn and to actuate the agitator switch 70. Upon detection of the actuation of the agitator switch 70 at block 254, control passes to a block 256 to play a Big Trouble instruction. The controller 110 outputs sound generation signals to the speaker 116 corresponding to phrase number 14 ("You have to take this many cards"), and selects one of phrase numbers 27 ("How do you like me now?") and 28 ("That's what I'm talking about") and outputs sound generation signals corresponding to the selected phrase to the speaker 116. Control passes to a blocked 258 to determine if a second part of a Big Trouble instruction will be output from the instruction unit 12. The controller 110 may be program to output a two-part Big Trouble instruction a predetermined percentage of the occurrences of the Big Trouble routine 250, such as 40% of the occurrences, or have some alternate algorithm or strategy for determining when the instruction should include a second part.

If the controller 110 determines that the Big Trouble instruction will not be a two-part instruction at block 258, control passes to a block 260 wherein the controller 110 evaluates whether the Big Trouble card 28 has been removed from the card slot 36 by determining whether the card switch 92 is actuated. After the opposing player has received the Big Trouble instruction from the instruction unit 12, the card 28 must be removed from the card slot 36 to continue the game. If the card 28 is removed from the card slot 36 and, correspondingly, the card switch 92 is no longer actuated, control passes to a block 262 wherein the controller 110 outputs sound generation signals to the speaker 116 to play an acknowledgment message, such as phrase number 17 ("Alright") of table 120, indicating that the instruction unit 12 has detected the removal of the card 28. After the acknowledgment message is output, control passes back to block 208 of the main gameplay routine 200 to wait for the next player to actuate one of the switches 70, 92, 112. If the card 28 has not been removed, control passes to a blocked 264 for determination of whether the agitator switch 70 is actuated while the card 28 is still actuating the card switch 92. If the agitator switch 70 is not actuated, control passes back to block 260 to wait for the card 28 to be removed from the card slot 36. If the agitator switch 70 is actuated while the card 28 is still in the card slot 36, control passes to a block 266 wherein the controller 110 outputs sound generation signals to the speaker 116 to broadcast a reminder message to the players to remove the card 28 from the card slot 36, such as phrase numbers 15 ("Slow down here") and 16 ("Take the card out"). After the instruction unit 12 outputs the reminder message, control passes back to block 260 to wait for the card 28 to be removed from the card slot 36.

If the controller 110 determines that the Big Trouble instruction is a two-part instruction at block 258, control passes to a block 268 for selection by the controller 110 of the second part of the instruction from the available instruction phrases 122 in the table 120. In the illustrated example, phrase number 25 instructs the opposing player to draw additional cards 16 from the deck and add them to the player's hand ("And take those cards too!"), and phrase number 26 instructs the opposing player to draw additional cards 16 from the deck and pass them on to another player ("And give those cards to another player"). The controller 110 may be configured to select one of the available instruction phrases randomly, sequentially, based on a fixed percentage, or based on some other method. After the second part of the instruction is selected, control passes to a block 270 wherein the controller 110 outputs sound generation signals to the speaker 116 to output a second part of the Big Trouble instruction including the selected second part of the instruction. As with the previous instructions and messages, the second part of the instruction may be a combination of multiple phrases 122 from the table 120. For example, the controller 110 may select and output one of phrase numbers 20 ("Hold up!"), 21 ("But wait!") and 22 ("Wait up!"), followed by phrase numbers 23 ("Time for some double trouble") and 24 ("Pop the bubble again"), and concluding with the selected one of phrase numbers 25 and 26. After the second part of the instruction is output by the instruction unit 12, the opposing player presses the die agitator 14 a second time to determine the number of cards 16 to be drawn from the deck and either kept in the player's hands or passed to another player as instructed. At the same time, control passes to a block 272 wherein the controller 110 waits for the agitator switch 70 to be actuated in response to the opposing player pressing the die agitator 14. When the controller 110 detects actuation of the agitator switch 70, control passes to a block 274 to replay the second part of the instruction as a reminder to the player. Control then passes to the block 260 to wait for the card 28 to be removed from the card slot 36 and to subsequently return to the primary gameplay routine 200 at block 208 as discussed above.

The flowcharts illustrate one embodiment of main gameplay and Big Trouble routines that may be programmed into the controller 110 or other memory of the instruction unit 12, and executed by the controller 110. Those skilled in the art will understand that other routines may be implemented in the instruction unit 12 to provide a desired gameplay for the game 10. For example, phrases other than those illustrated in table 120 of FIG. 7 may be used to control the gameplay of game 10 and the actions of the players. Moreover, the musical individual displays provided by the instruction unit 12 may be configured to implement a desired theme in the game 10. Still further, the controller 110 may be programmed with any desired method or strategy for selecting between a plurality of available phrases, colors and background music during a given portion of the gameplay routine 200 and/or Big Trouble routine 250. Such alternative routines and programming are contemplated by the inventors as having use with the game 10 and instruction unit 12 of the present invention.

Additional configurations of the instruction unit 12 and, correspondingly, the gameplay of the game 10 are contemplated by the inventors. As previously discussed, alternative mechanical random selection mechanisms may be implemented for selecting numbers during the course of the game 10, and other visual output devices may be implemented for providing a visually perceptible output corresponding to the color or other item selected by the controller 110 of the instruction unit 12. As a further alternative, the functions of the mechanical selection mechanism and the electronic selection mechanism may be switched such that the mechanical selection mechanism randomly selects and displays one of the available colors, and the controller 110 is programmed to randomly or otherwise select from the numbers that are utilized in the gameplay of the game 10. Additionally, the game 10 may be configured to utilize groups of items that are relevant to the gameplay of the implemented game other than numbers and colors, such as geometric shapes, plants, animals, characters or any other class of items that may be integrated in the gameplay of the game 10 and selected by mechanical and electrical selection mechanisms implemented in the instruction unit 12.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A game for multiple players comprising:

an instruction unit comprising:

a mechanical number selection device configured to randomly select one of a plurality of available numbers for the game, a first input device operatively connected to the mechanical number selection device and responsive to actuation of the mechanical number selection device, a first output device, and a color selection mechanism operatively connected to the first input device and the second input device, wherein the color selection mechanism is actuated by a player actuating the mechanical number selection device and the detection of the actuation of the mechanical number selection device by the first input device, wherein the color selection mechanism selects one of a plurality of colors associated with the game in response to the actuation of the mechanical number selection device, wherein the color selection mechanism selects the color independent of the number selected by the mechanical number selection device, and wherein the color selection mechanism causes the first output device to provide a sensory perceptible output corresponding to the color selected by the color selection mechanism; and a plurality of game cards each having gameplay indicia disposed thereon.

2. A game as defined in claim 1, wherein the mechanical number selection device comprises a mechanical agitator having a die disposed therein, wherein the available numbers for the game are disposed on the faces of the die, and wherein the mechanical agitator is configured to randomly reorient the die when the agitator is actuated.

3. A game as defined in claim 1, wherein for each of the plurality of colors associated with the game the plurality of game cards includes a subset of the game cards having indicia with the particular one of the plurality of colors.

4. A game as defined in claim 1, wherein the first output device comprises a plurality of LEDs each having a color corresponding to one of the colors associated with the game, and wherein the color selection mechanism illuminates the LEDs having the same color as the color selected by the color selection mechanism.

5. A game as defined in claim 1, wherein the first output device comprises a speaker, and wherein the color selection mechanism causes the speaker to output an audible instruction corresponding to the color selected by the color selection mechanism.

6. A game as defined in claim 1, comprising a second output device operatively connected to the color selection mechanism, wherein the first output device comprises a plurality of LEDs each having a color corresponding to one of the colors associated with the game, wherein the second output device comprises a speaker, and wherein the color selection mechanism illuminates the LEDs having the same color as the color selected by the color selection mechanism, and causes the speaker to output an audible instruction corresponding to the color selected by the color selection mechanism.

7. A game as defined in claim 1, comprising a second input device operatively connected to the color selection mechanism, wherein the color selection mechanism is actuated by a player at the second input device, and wherein the color selection mechanism causes the first output device to provide a sensory perceptible output indicative of the end of the game in response to the actuation of the second input device.

8. A game as defined in claim 7, comprising a third input device operatively connected to the color selection mechanism and configured to be actuated by one of the game cards being disposed proximate thereto, wherein the color selection mechanism is actuated by a player at the third input device, and wherein the color selection mechanism causes the first output device to provide a sensory perceptible output instructing a player to actuate the mechanical number selection device in response to the actuation of the third input device.

9. An instruction unit as defined in claim 1, wherein the color selection mechanism comprises a controller programmed to actuate in response to the detection of the actuation of the mechanical number selection device by the first input device.

10. A method of gameplay for a game for a plurality of players, the method comprising:

providing an instruction unit and a deck of game cards, wherein each game card has game indicia disposed thereon, and wherein the instruction unit has a mechanical number selection mechanism and is configured to select one of a plurality of available colors in response to actuation of the mechanical number selection mechanism;

distributing a plurality of the game cards to each participant of the game;

each player in turn actuating the mechanical number selection mechanism to randomly select one of the available numbers and to cause the instruction unit to select one of the available colors;

providing at the instruction unit a sensory perceptible indication of the color selected by the instruction unit; and discarding game cards distributed to the player and having colored indicia disposed thereon matching the color selected and indicated by the instruction unit onto a discard pile up to the number indicated by the mechanical number selection mechanism.

11. A method of gameplay for a game as defined in claim 10, wherein the instruction unit has an input device, and wherein the method comprises:

a player actuating the input device after discarding the last card in the player's hand onto the discard pile; and providing at the instruction unit a sensory perceptible indication of the end of the game in response to the actuation of the input device.

12. A method of gameplay for a game as defined in claim 10, wherein the instruction unit has an input device configured to receive a game card, and the deck of game cards includes a subset of the game cards having indicia disposed thereon corresponding to the input device, and wherein the method comprises:

during a player's turn, inserting a game card having indicia corresponding to the input device from the player's hand into the input device;

providing at the instruction unit an instruction for the player inserting the card into the input device to select another player to actuate the mechanical number selection mechanism and for the selected player to draw the number of cards indicated by the mechanical number selection mechanism in response to detecting the insertion of the card into the input device; and the player inserting the card selecting an opposing player to actuate the mechanical number selection mechanism.

13. A method of gameplay for a game as defined in claim 12, comprising:

actuation by the selected opposing player of the mechanical number selection mechanism; and drawing by the selected opposing player a number of cards from the deck corresponding to the number indicated by the mechanical number selection mechanism.

14. A method of gameplay for a game as defined in claim 13, comprising:

determining at the instruction unit an additional instruction in response to actuation of the mechanical number selection mechanism by the selected opposing player;

providing at the instruction unit a sensory perceptible additional instruction for the selected opposing player; and the selected opposing player executing the additional instruction.

15. A method of gameplay for a game as defined in claim 14, wherein the additional instruction is an instruction for the selected opposing player to select additional cards from the deck and keep the selected cards.

16. A method of gameplay for a game as defined in claim 14, wherein the additional instruction is an instruction for the selected opposing player to select additional cards from the deck and pass the selected cards to another player.

* * * * *